US006689038B2

(12) United States Patent
White

(10) Patent No.: US 6,689,038 B2
(45) Date of Patent: Feb. 10, 2004

(54) METHOD AND APPARATUS FOR INTERRUPTING INTERFOLDED SHEETS CREATED BY A LAPPING INTERFOLDER

(75) Inventor: Barton J. White, Marinette, WI (US)

(73) Assignee: FPNA Acquisition Corporation, Green Bay, WI (US)

( * ) Notice: Subject to any disclaimer, the term of this patent is extended or adjusted under 35 U.S.C. 154(b) by 0 days.

(21) Appl. No.: 10/165,994

(22) Filed: Jun. 10, 2002

(65) Prior Publication Data

US 2003/0228965 A1 Dec. 11, 2003

(51) Int. Cl.[7] ..... B31B 1/14

(52) U.S. Cl. ..... 493/360; 493/357; 493/374; 270/39.06

(58) Field of Search ..... 493/357–360, 493/344, 374; 270/39.01, 39.05, 39.06, 32

(56) References Cited

U.S. PATENT DOCUMENTS 4,778,441 A * 10/1988 Couturier ..... 493/425
4,824,426 A * 4/1989 DuFresne ..... 493/346
5,067,698 A * 11/1991 Stemmler ..... 270/39.07
5,088,707 A * 2/1992 Stemmler ..... 270/39.02
5,147,273 A * 9/1992 Rottmann et al. ..... 493/349
5,310,398 A * 5/1994 Yoneyama ..... 493/430
6,165,116 A 12/2000 White
6,228,014 B1 * 5/2001 De Matteis et al. ..... 493/424

* cited by examiner

*Primary Examiner*—Rinaldi I. Rada
*Assistant Examiner*—Hemant M. Desai
(74) *Attorney, Agent, or Firm*—Boyle, Fredrickson, Newholm, Stein & Gratz, S.C.

(57) ABSTRACT

A system for forming a discontinuity in a stack of interfolded sheets formed by a pair of folding rolls acting on a stream of overlapping sheets supplied from a pair of feed rolls. At a desired sheet count, the feed rolls and folding rolls are operated to eliminate the overlap between a downstream sheet and an upstream sheet by operating the feed rolls and the folding rolls at a differential rate of speed, which results in advancement of the downstream sheet relative to the upstream sheet. The feed rolls are slowed upon discharge of the downstream sheet, to slow advancement of the upstream sheet while the downstream sheet is moved downstream by the folding rolls. The separation between the downstream and upstream sheets forms a discontinuity in the stack to divide the stack into groups of sheets.

16 Claims, 9 Drawing Sheets

METHOD AND APPARATUS FOR INTERRUPTING INTERFOLDED SHEETS CREATED BY A LAPPING INTERFOLDER

BACKGROUND AND SUMMARY OF THE INVENTION

This invention relates to a system for interfolding sheets, such as paper toweling, and more particularly to an interfolding system which is capable of forming a discontinuity in a stack of interfolded sheets to enable the stack to be separated at predetermined locations according to a desired sheet count.

A stack of interfolded sheets can be formed in different ways. In one system, a pair of webs are severed into sheets, which are then brought together in a staggered relationship. The sheets are supplied to an interfolder, which is operable to form the staggered sheets into an interfolded stack. In another system, commonly known as a lapping interfolder, a single web is cut into successive sheets which :are then fed through a pair of retard rolls, which are operable to create an overlap in the successive sheets. The overlapped sheets are then supplied to a pair of folding rolls which fold the lapped sheets into an interfolded stack.

From the discharge of the folding rolls, a predetermined number of the sheets are separated for further processing, such as for packaging in a sleeve-type package or the like and then subsequent severing of the sheets to length. Various types of mechanisms are known to separate the stack to a desired sheet count. Examples of such mechanisms are disclosed in Hathaway U.S. Pat. Nos. 4,717,135 and 4,721,295; Couturier U.S. Pat. No. 4,770,402; Stemmler U.S. Pat. No. 5,088,707, and White U.S. Pat. No. 6,165,116. The disclosures of such patents are hereby incorporated by reference. The White patent discloses an arrangement for forming a gap in one of two streams of sheets supplied to the interfolding rolls, to create a discontinuity in the interfolded stack. The discontinuity in the stack facilitates separation of a portion of the stack from the remainder of the stack, for subsequent processing. In White, the interruption in the sheet supply occurs in one of the streams of sheets upstream of the interfolding rolls. Stemmler U.S. Pat. No. 5,088,707 and Hathaway U.S. Pat. No. 4,717,135 also show systems for manipulating the streams of sheets upstream of the interfolder, for creating a separation in the stack. Couturier U.S. Pat. No. 4,770,402 discloses a separator located downstream of the interfolding rolls for counting and separating a clip of sheets according to a desired sheet count.

It is an object of the present invention to provide an apparatus and method for creating a discontinuity or separation in a stack of interfolded sheets formed using a lapping interfolder, in which the discontinuity or separation is formed upstream of the interfolding rolls. Another object of the invention is to provide such an apparatus and method which can be carried out by modifying operation of existing components of a lapping interfolder. Yet another object of the invention is to provide such an apparatus and method which is capable of creating a discontinuity in a stack of interfolded sheets, without any significant reduction in the speed of operation of the interfolder. A still further object of the invention is to provide such an apparatus and method which is relatively simple in its components and operation, yet which can be operated to reliably form a discontinuity or interruption in a stack of interfolded sheets.

In accordance with the present invention, a web is supplied to a severing arrangement, which functions to sever the web into separate sheets which are then directed toward an interfolder, which may be in the form of a pair of counter-rotating interfolding rolls. At a location downstream of the severing arrangement and upstream of the interfolding rolls, the severed sheets are supplied to a nip defined by a pair of counter-rotating rolls. In one form, the counter-rotating rolls between the severing arrangement and the interfolding rolls may be in the form of conventional retard rolls, which are operated at a speed slower than the speed at which the successive severed sheets are supplied from the severing arrangement. In conventional operation, the retard rolls function to create an overlap of successive sheets, and the overlapped sheets are then supplied from the retard rolls to the nip of the interfolding rolls.

To create an interruption or discontinuity in the interfolded sheets formed by the interfolding rolls, the interfolding rolls a pair of rolls upstream of the interfolding rolls, which may be the retard rolls, are operated at a differential speed to advance the trailing edge of a downstream sheet out of overlapping relationship with the leading edge of the adjacent upstream sheet. The speed differential in operation of the interfolding rolls and the upstream rolls, which may be the retard rolls, is preferably carried out by selectively slowing the speed of rotation of the retard rolls while maintaining the speed of operation of the interfolding rolls. In this manner, the downstream sheet is advanced through the nip of the interfolding rolls at a speed greater than the speed at which the next upstream sheet is advanced by the retard rolls toward the nip of the interfolding rolls. The speed of operation of the retard rolls is selected such that, when the leading edge of the upstream sheet reaches the nip of the interfolding rolls, the trailing edge of the downstream sheet has been advanced through the nip of the interfolding rolls ahead of the leading edge of the upstream sheet, to eliminate the overlapping relationship between the downstream and upstream sheets. As a result, the downstream sheet is advanced through the nip of the interfolding rolls prior to discharge of the leading edge of the upstream sheet from the nip of the interfolding rolls. In this manner, the upstream and downstream sheets are not interfolded, to create the desired interruption or discontinuity in the stack of sheets to facilitate separation of the sheets for further processing. After the downstream sheet and the upstream sheet have been separated in this manner, the speed of rotation of the retard rolls is returned to normal, to advance successive sheets toward the interfolding rolls in a conventional manner. The prior slowing in the speed of operation of the retard rolls causes an increase in the degree of overlap between the upstream sheet and the next adjacent upstream sheet, which are then fed together by the retard rolls toward the interfolding rolls, and interfolded on top of the end panel of the downstream sheet to initiate formation of a new group of sheets in the stack. Conventional operation of the lapping interfolder then continues in this manner, until a desired number of sheets have been interfolded in the new group and a discontinuity or interruption in the stack is then subsequently formed, to separate the group of sheets from the next group of sheets to be formed in the stack.

The invention contemplates an apparatus that functions in the manner described above so as to create an interruption or discontinuity in a stack of interfolded sheets, as well as a method of operating a sheet processing system so as to create an interruption or discontinuity in a stack of interfolded sheets, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
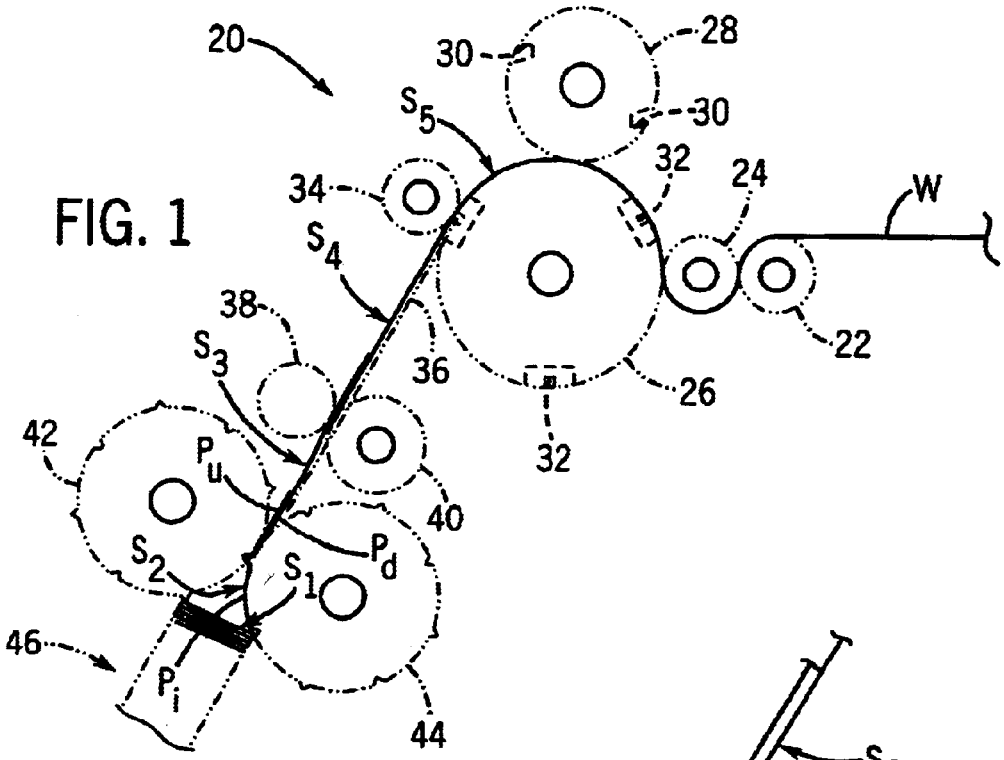
FIG. 1 is a schematic side elevation view of an initial step in operation of a lapping interfolder system for creating a stack of interfolded sheets.

FIG. 1 illustrates a lapping interfolder system 20 which is operable to create a stack of interfolded sheets from a web W, which may be formed of any type of material, such as a material suitable for forming paper toweling or the like. Interfolder system 20 includes a pair of pull rolls 22, 24 which define a nip therebetween. Web W is trained over pull roll 22 and downwardly through the nip between pull rolls 22 and 24, and then upwardly about pull roll 24 through a nip defined between pull roll 24 and a bed roll 26. Web W is then trained about the upper area of bed roll 26, and travels below a knife roll 28 which includes knives 30 which are operable to sever web W into individual sheets, in cooperation with anvils 32 associated with bed roll 26. The severed sheets, shown at S1, S2, etc., are supplied to a nip defined by bed roll 26 in combination with a lap roll 34. The upper end of an inclined ramp 36 is located immediately downstream of the nip between lap roll 34 and bed roll 26. The sheets S formed by knife roll 28 are supplied through the nip defined by bed roll 26 and lap roll 34, which functions to move sheets S downwardly along ramp 36 toward a nip defined between a pair of retard rollers, including an upper retard roll 38 and a lower retard roll 40. Folding rolls 42, 44 are located downstream of retard rolls 38, 40 and cooperate :with each other to fold sheets S and to supply sheets S to a stack of interfolded sheets, shown at 46.

Folding rolls 42, 44 have complementary folding bars and recesses which act on sheets S to form each sheet S into three panels. With reference to sheet S1, which is representative of all sheets S, each sheet S is formed to define a downstream panel $P_d$, an upstream panel $P_u$, and an intermediate panel $P_i$. A downstream fold $F_d$ separates panels $P_d$ and $P_i$, and an upstream fold $F_u$ separates upstream panel $P_u$ from intermediate panel $P_i$. Sheets S are interfolded in stack 46 by interleaving the downstream panel $P_d$ of an upstream sheet, such as $S_2$, between the upstream panel $P_u$ and the intermediate panel $P_i$ of the next downstream sheet, such as shown at $S_1$. This process is repeated to form sheets S into the interfolded stack 46.

Figure 3:
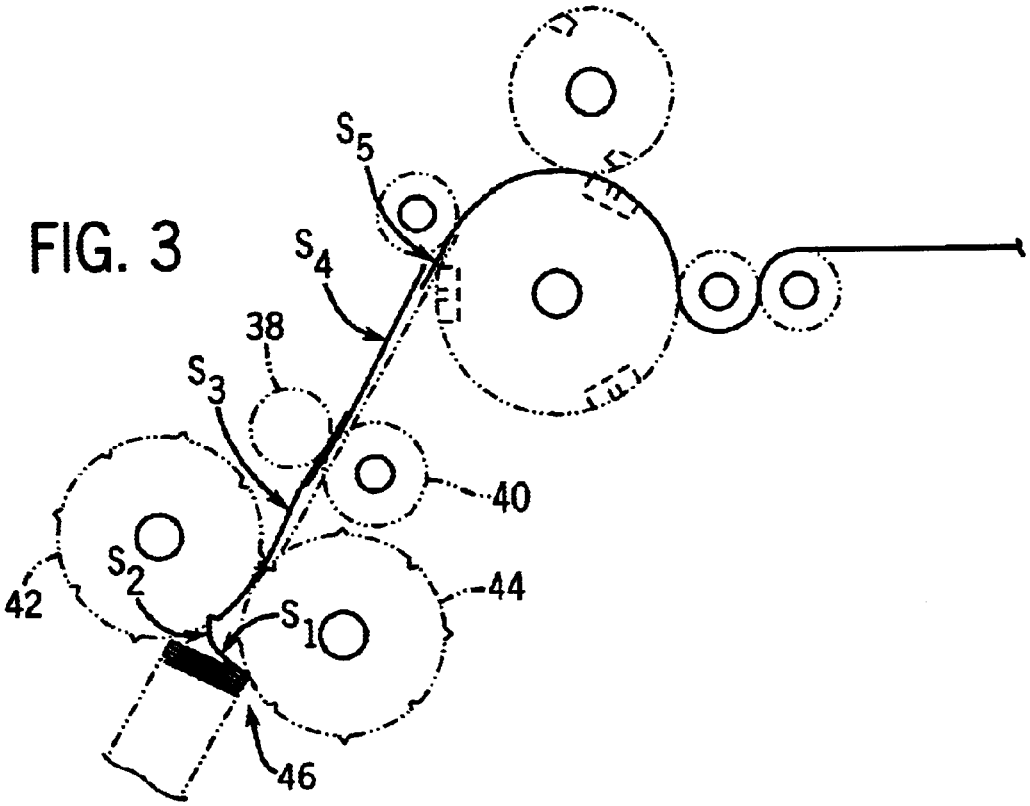
FIG. 3 is a view similar to FIG. 1, showing continued formation of a stack of interfolded sheets immediately prior to completion of a group of sheets in the stack.
Figure 4:
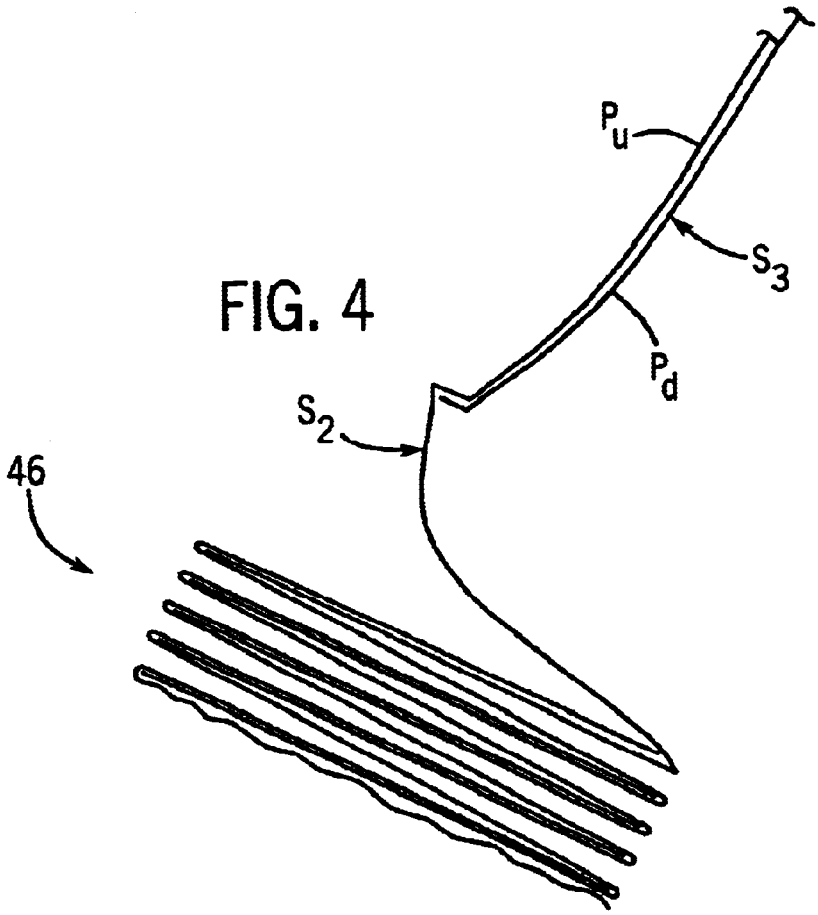
FIG. 4 is a view similar to FIG. 2, showing the stack of interfolded sheets corresponding to the position of the lapping interfolder system of FIG. 3.

The general construction and operation of lapping interfolder system 20 is known in the art, for supplying overlapped sheets to folding rolls 42, 44 to form stack 46. As shown in FIG. 3, in order to overlap an upstream sheet such as $S_5$ with a downstream sheet such as $S_4$, retard rolls 38, 40 are operated at a slower speed than bed roll 26 and lap roll 34. Representatively, retard rolls 38, 40 are operated at a surface speed of approximately ⅔ of the surface speed of bed roll 26 and lap roll 34. When the leading edge of the downstream sheet S4 reaches the nip between retard rolls 38, 40, lap roll 34 functions to lift the trailing end of sheet S4 off of ramp 36, due to the slower surface speed of operation of retard rolls 38, 40 relative to the surface speed of bed roll 26 and lap roll 34. Simultaneously, the leading edge of the next upstream sheet $S_5$ is fed below the trailing edge of the downstream sheet $S_4$ onto ramp 36. Due to the faster speed of advancement of the upstream sheet $S_5$, sheet $S_5$ continues to slide below the trailing end of sheet $S_4$ until the downstream edge of sheet $S_5$ reaches the nip between retard rolls 36, 40, along with the portion of sheet $S_4$ which is overlapped by sheet $S_5$.

The process then repeats such that the downstream end of the next adjacent sheet is fed below the trailing end of sheet $S_5$.

Figure 2:
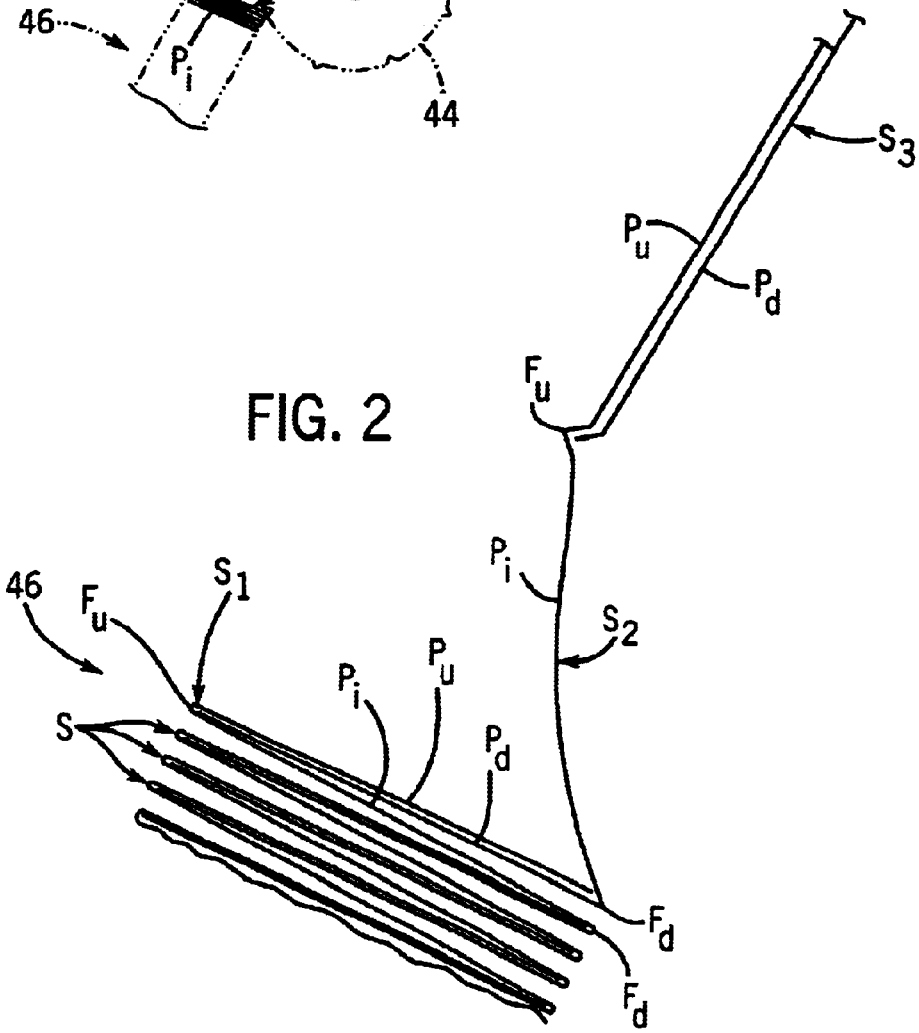
FIG. 2 is an end elevation view of a stack of interfolded sheets corresponding to the position of the lapping interfolder system of FIG. 1.

This process is illustrated in FIG. 3, which shows sheets $S_2$, $S_3$, $S_4$ and $S_5$ advanced from their positions of FIGS. 1 and 2, by operation of retard rolls 38, 40 advancing the lapped sheets toward folding rolls 42, 44, and operation of folding rolls 42, 44 to move the folded sheets toward stack 46.

Stack 46 is formed of a series of groups of interfolded sheets S, with each group corresponding to a desired count of sheets S destined to be packaged, cut and shipped to a user. When it is desired to create an interruption or discontinuity in stack 46, between adjacent groups of sheets S, interfolder system 20 is operated as shown in FIGS. 5–18 and as described hereafter. Typically, the desired sheet count is ascertained by tracking revolutions of certain of the components of interfolder system 20, e.g. folding rolls 42, 44.

Figure 5:
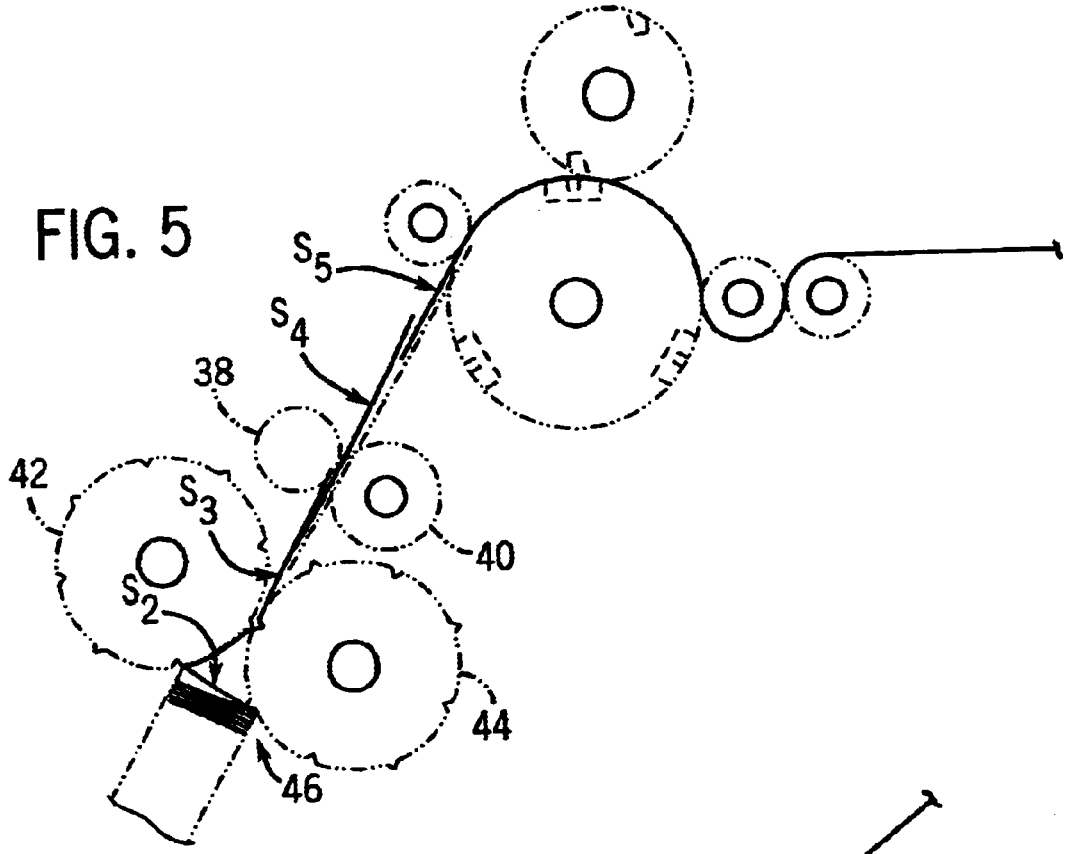
FIG. 5 is a view similar to FIG. 3, showing initial operation of the interfolder system of the present invention for creating a discontinuity or interruption in the stack of interfolded sheets between successive groups of sheets.
Figure 6:
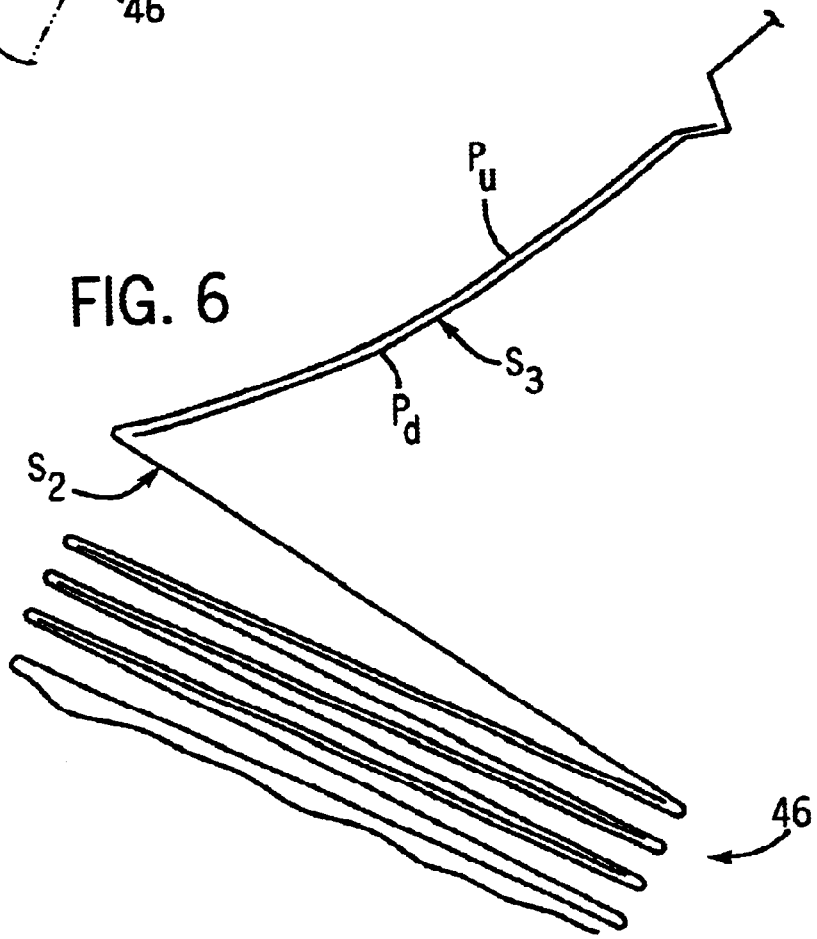
FIG. 6 is view similar to FIG. 4, showing the stack of interfolded sheets corresponding to the position of the lapping interfolder system of FIG. 5.
Figure 7:
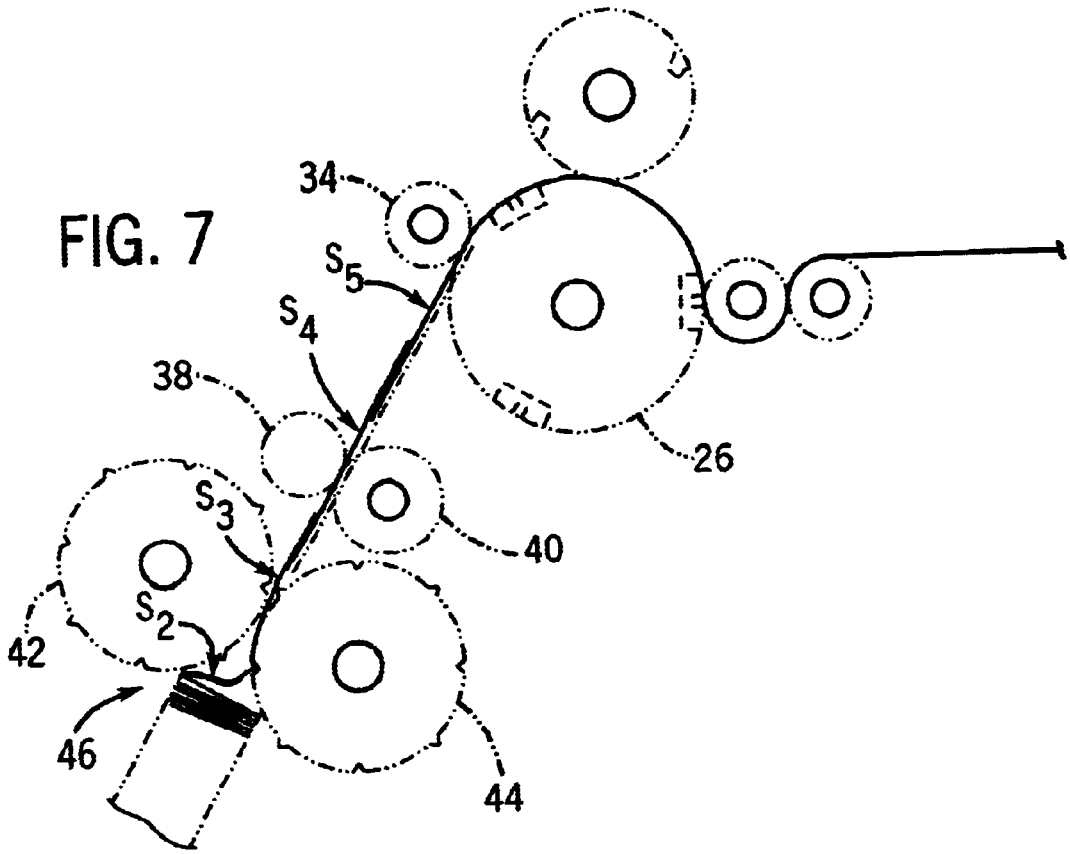
FIG. 7 is a view similar to FIGS. 5, showing continued operation of the interfolder system to create a discontinuity or interruption between adjacent groups of sheets in the stack.
Figure 8:
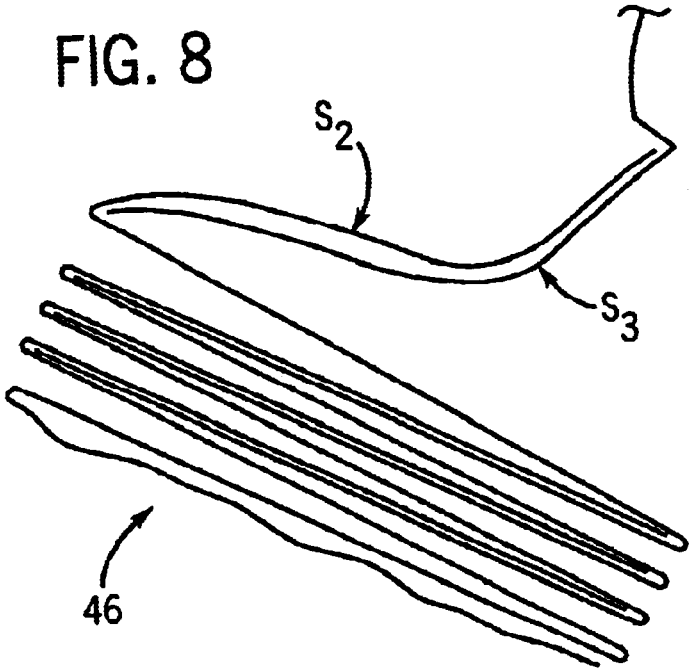
FIG. 8 is a view similar to FIG. 6, showing the stack of interfolded sheets corresponding to the position of the lapping interfolder system of FIG. 7.
Figure 9:
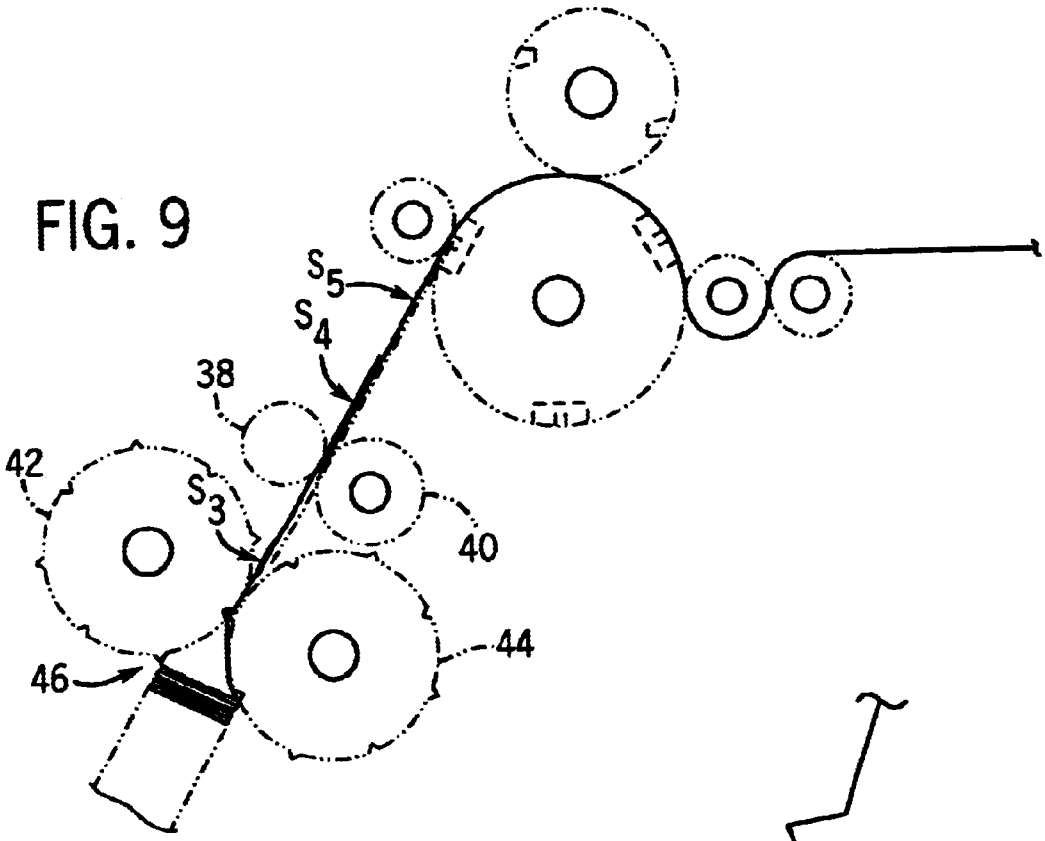
FIG. 9 is a view similar to FIG. 7, showing still further operation of the interfolder system for creating a discontinuity or interruption between adjacent groups of sheets in the stack.
Figure 10:
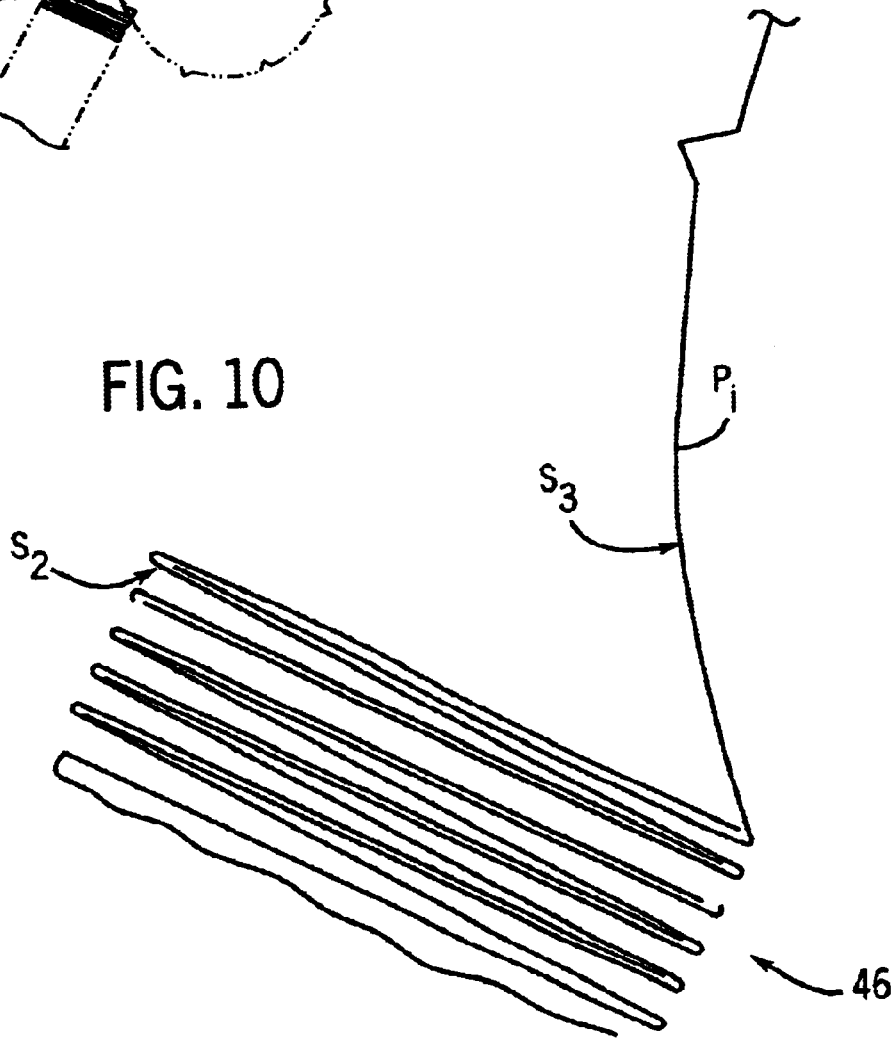
FIG. 10 is a view similar to FIG. 8, showing the stack of interfolded sheets corresponding to the position of the lapping interfolder system of FIG. 9.

Immediately upon discharge of the trailing end of sheet $S_3$ from the nip between retard rolls 38, 40, such that only sheet $S_4$ is located within the nip between retard rolls 38, 40, the surface speed of rotation of retard rolls 38, 40 is further slowed, to slow the advancement of the leading edge of sheet $S_4$ toward the nip between folding rolls 42, 44. The surface speed of rotation of folding rolls 42, 44 is maintained constant, to continue advancement of sheet $S_3$. In this manner, the trailing end of sheet $S_3$ is moved faster toward the nip of folding rolls 42, 44 than the leading end of sheet $S_4$. Simultaneously, the leading edge of sheet $S_5$ is moved downstream to overlap with the trailing portion of sheet $S_4$. FIGS. 5 and 7 illustrate such advancement of sheets $S_3$, $S_4$, and $S_5$ by operation of folding rolls 42, 44, retard rolls 38, 40 and lap roll 34 and bed roll 26, respectively. Continued advancement of sheets $S_3$, $S_4$, and $S_5$ in this manner results in the leading end of sheet $S_5$ reaching the nip between retard rolls 38, 40, with the degree of overlap between the downstream portion of sheet $S_5$ and the upstream portion of sheet $S_4$ being greater than during normal operation, due to the slowed surface speed of operation of retard rolls 38, 40.

Figure 11:
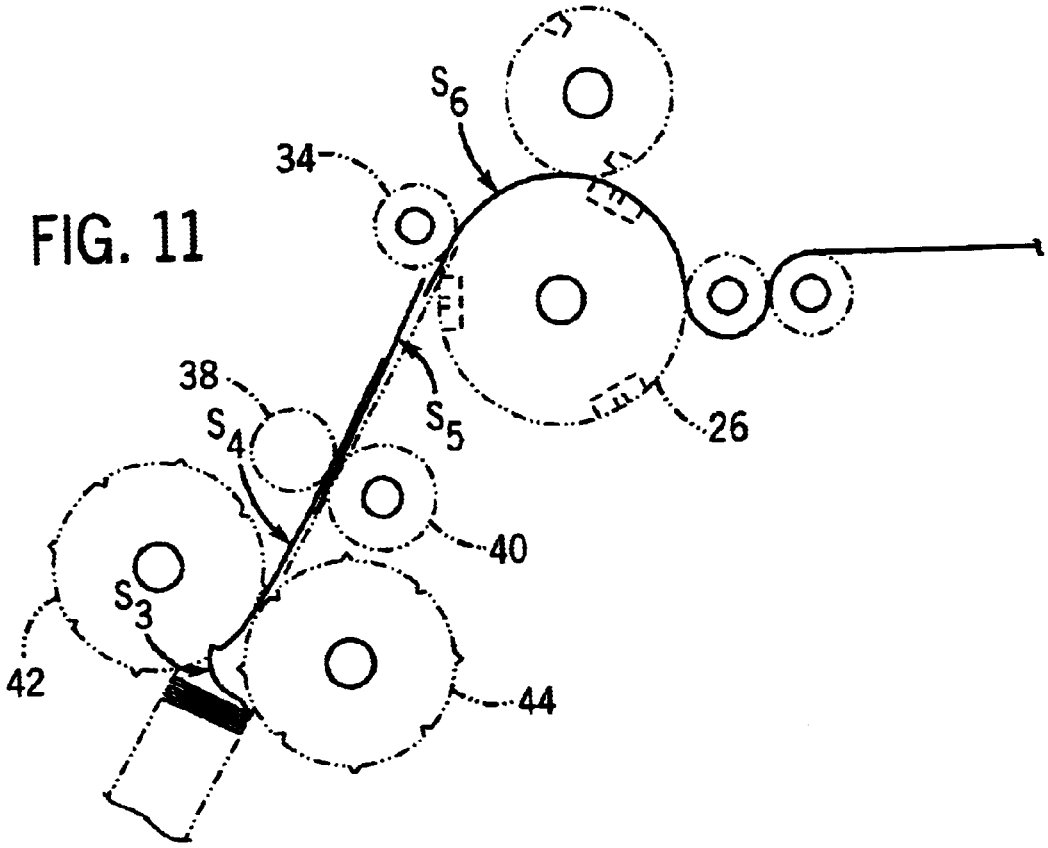
FIG. 11 is a view similar to FIG. 9, showing further operation of the interfolder system and separation of the downstream sheet in a group of sheets in the stack from the sheet upstream therefrom.
Figure 12:
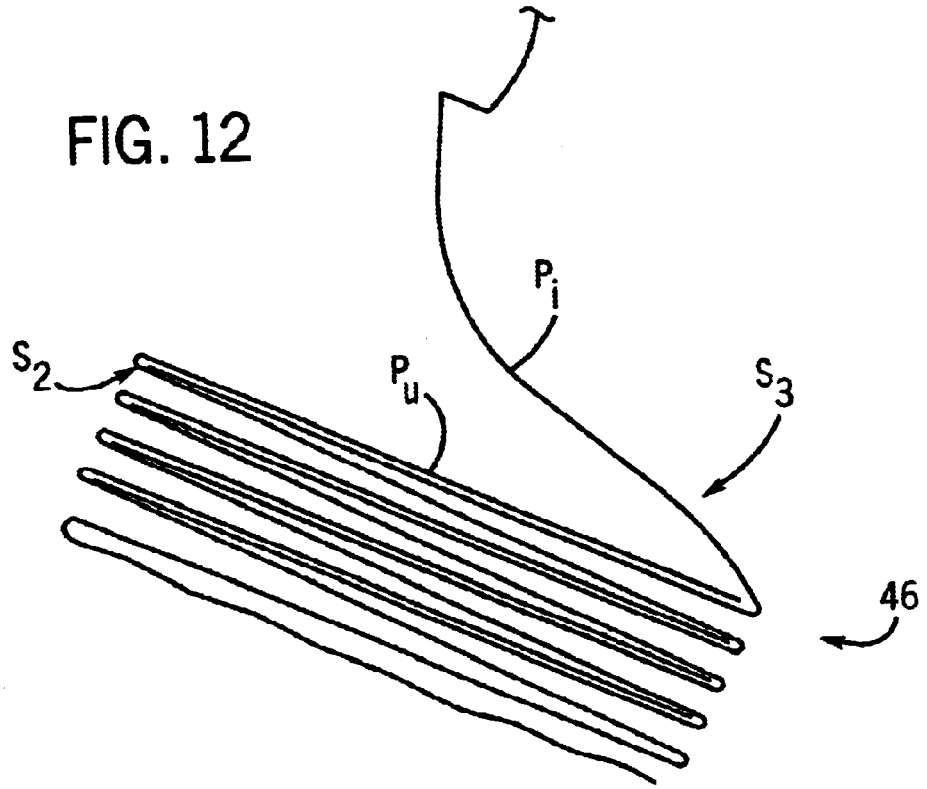
FIG. 12 is a view similar to FIG. 10, showing the stack of interfolded sheets corresponding to the position of the lapping interfolder system of FIG. 11.

FIG. 11 illustrates separation of the upstream edge of sheet $S_3$ from the downstream edge of sheet $S_4$ by virtue of the different surface speed in operation of folding rolls 42, 44 relative to retard rolls 38, 40. In this manner, the upstream panel $P_u$ of sheet $S_3$ is fed through the nip between folding rolls 42, 44 without any overlapping portion of sheet $S_4$. Sheet $S_5$ is discharged from the nip between lap roll 34 and bed roll 26, and is immediately slowed by the slower surface speed of operation of retard rolls 38, 40. This functions to lift the trailing edge of sheet $S_5$ away from ramp 36, and to simultaneously feed the upstream edge of the next adjacent sheet $S_6$ between sheet $S_5$ and ramp 36.

Figure 13:
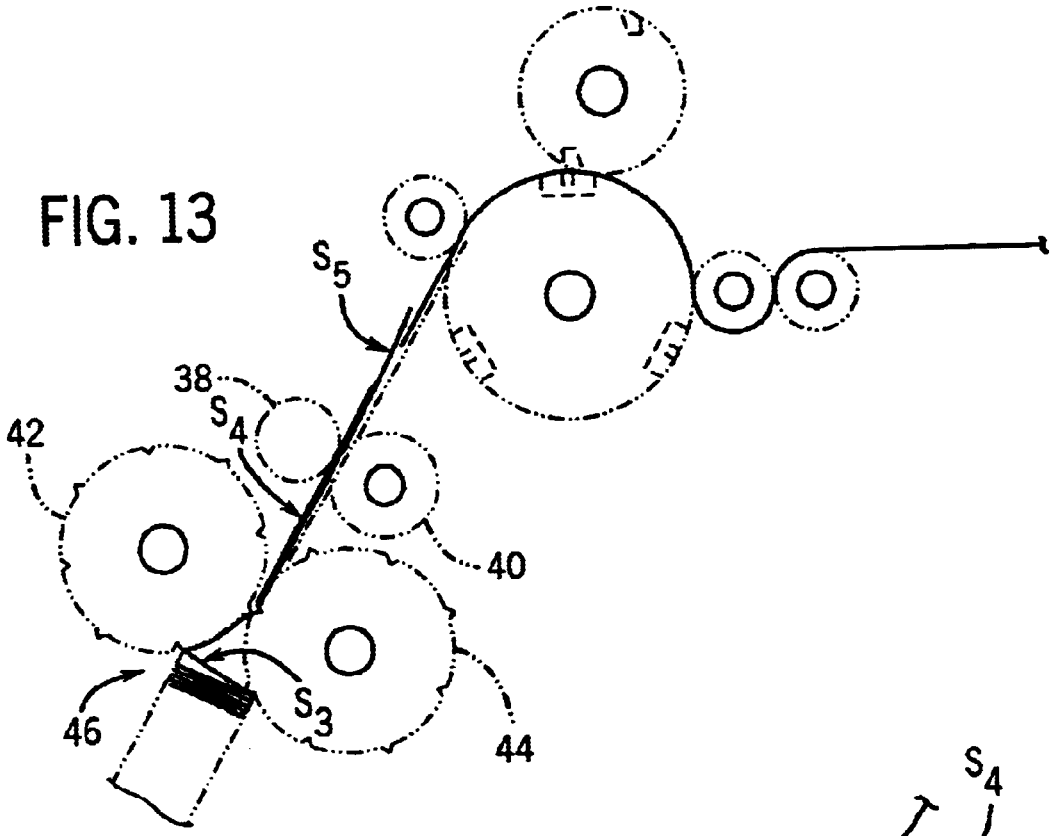
FIG. 13 is a view similar to FIG. 11, showing continued operation of the interfolder system and the discontinuity in the successive sheets positioned between the interfolding rollers, and subsequent overlap of the next upstream sheet with the initial sheet in the successive group of sheets.
Figure 14:
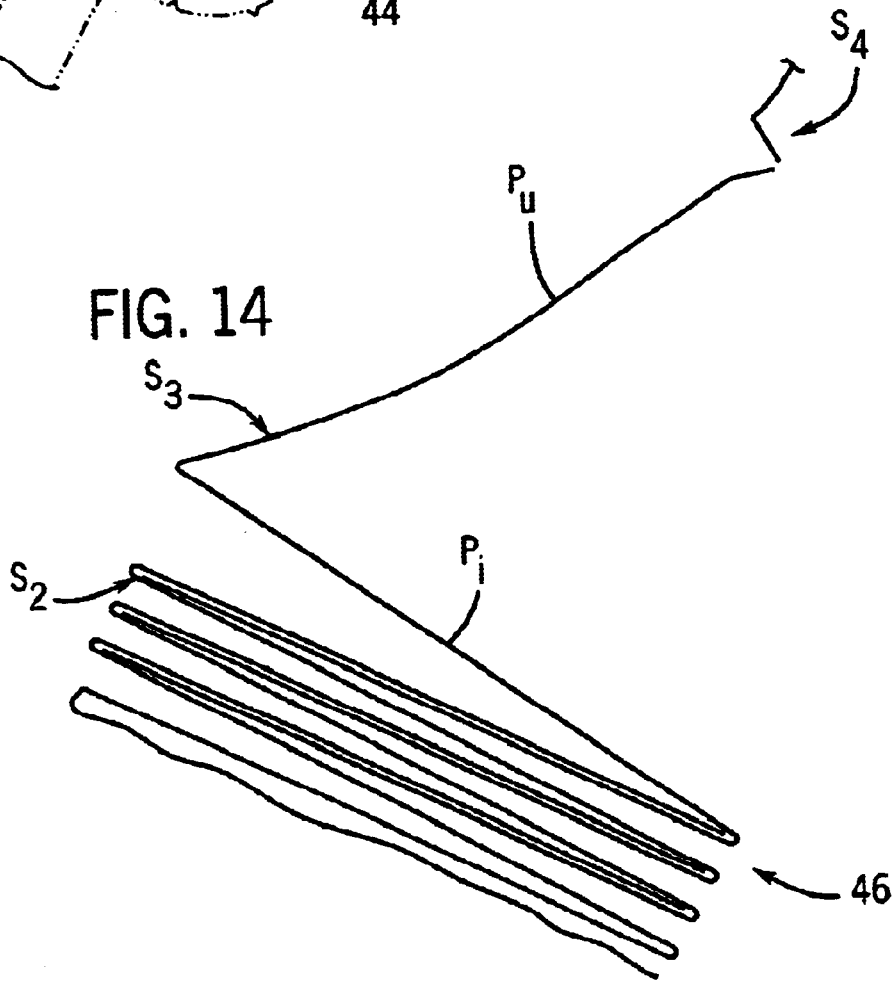
FIG. 14 is a view similar to FIG. 12, showing the stack of interfolded sheets corresponding to the position of the lapping interfolder system of FIG. 13.
Figure 15:
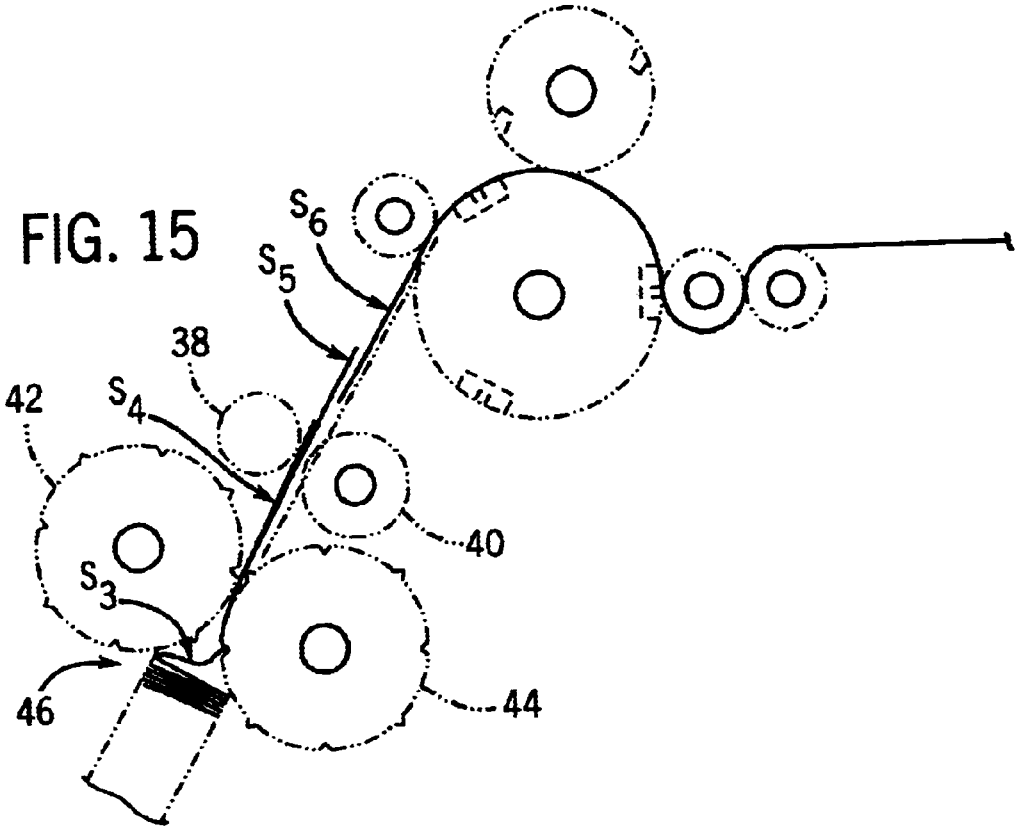
FIG. 15 is a view similar to FIG. 13, showing still further continued operation of the interfolder system and discharge of the trailing end of the downstream sheet onto the stack and initial movement of the leading edge of the upstream sheet toward the stack.
Figure 16:
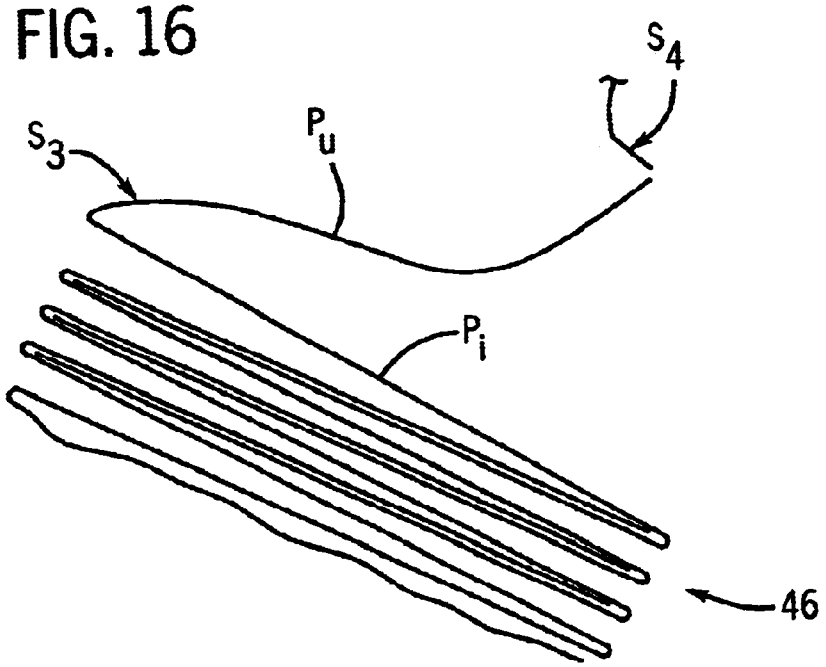
FIG. 16 is a view similar to FIG. 14, showing the stack of interfolded sheets corresponding to the position of the lapping interfolder system of FIG. 15.
Figure 17:
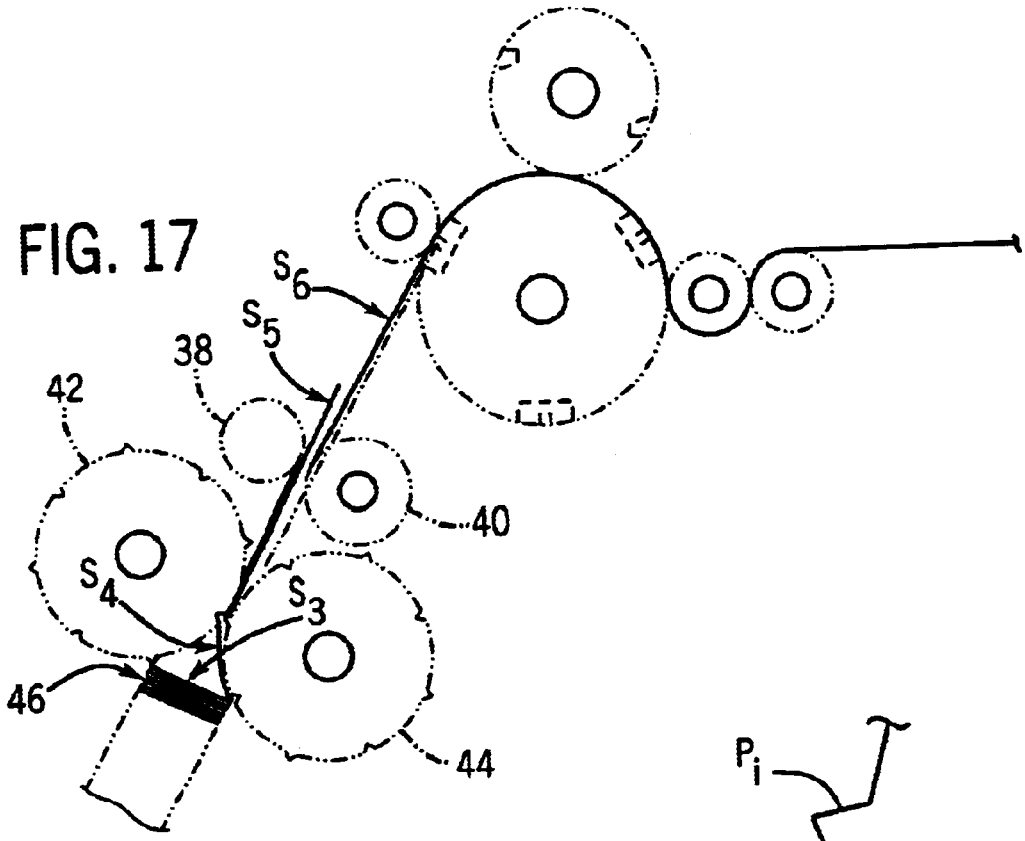
FIG. 17 is a view similar to FIG. 15, showing complete discharge of the trailing end of the downstream sheet onto the stack and application of the downstream panel of the upstream sheet onto the stack.
Figure 18:
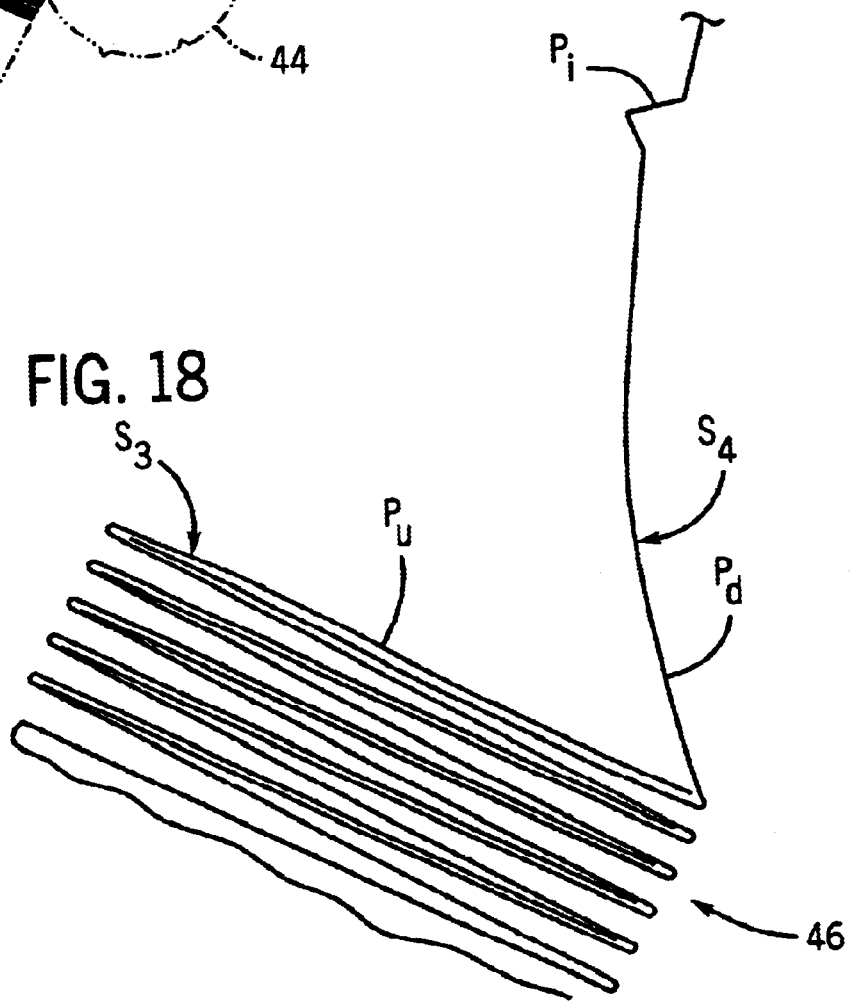
FIG. 18 is a view similar to FIG. 16, showing the stack of interfolded sheets corresponding to the position of the lapping interfolder system of FIG. 17.

Upon separation of the overlap between sheet $S_3$ and sheet $S_4$, retard rolls 38, 40 are returned to their original surface speed and normal operation of interfolder system 20 resumes. FIGS. 13 and 15 show subsequent operation of folding rolls 42, 44 to place the upstream panel $P_u$ of sheet $S_3$ onto the intermediate panel $P_i$ of sheet $S_3$. FIGS. 15 and 17 show subsequent movement of the downstream panel $P_d$ of sheet $S_4$ onto the upstream panel $P_u$ of $S_3$. As can be appreciated, there is no overlap between sheets $S_3$ and $S_4$, such that a discontinuity or interruption is formed in stack 46 at the area between sheets $S_3$ and $S_4$.

The result of the elimination in the overlap between sheets $S_3$ and $S_4$ is an increase in the area of overlap between sheets $S_4$ and $S_5$. Operation of interfolder system 20 continues such that the overlapped area of sheets $S_4$ and $S_5$ is fed through folding rolls 42, 44, and forms a part of the next group of interfolded sheets S formed in stack 46. When the desired sheet count has again been obtained, the process as shown and described is repeated so as to create another separation between adjacent groups of sheets to facilitate separation for processing.

The specific manner of operation of the components of interfolder system 20 is generally as is known. Retard rollers 38, 40 are interconnected with a controller and a motor which provides rapid deceleration and acceleration in the surface speed of rotation of rollers 38, 40.

While the invention has been shown and described with respect to a particular embodiment, it is contemplated that variations and alternatives are possible and are contemplated as being within the scope of the present invention. For example, and without limitation, while the invention has been shown and described with respect to altering the speed of operation of retard rolls 38, 40, it is understood that slowing advancement of a sheet at any location after formation of the sheet and prior to supply of the sheet to the folding rolls will be operable to create the desired discontinuity or interruption in the interfolded sheets. For example, a set of rollers could be interposed between lap roll 34 and retard rollers 38, 40 for shifting the position of a sheet rearwardly to eliminate the overlap with the next downstream sheet. It is also contemplated that the downstream sheet may be advanced other than by means of the folding rolls while advancement of the upstream sheet is slowed, e.g. by means of a pair of additional rolls interposed between retard rolls 38, 40 and folding rolls 42, 44. Further, while folding rolls 42, 44 are described as being maintained at a constant speed of rotation, it is also contemplated that the speed of operation of folding rolls 42, 44 may be increased so as to accelerate the separation in the overlap between the downstream and upstream sheets. It is also contemplated that the speed of a downstream sheet may be increased, rather than slowed, upstream of the folding rolls in order to advance it out of overlapping relationship with the sheet upstream therefrom, to create the desired separation or interruption in the stack when discharged from the folding rolls.

Various alternatives and embodiments are contemplated as being within the scope of the following claims particularly pointing out and distinctly claiming the subject matter regarded as the invention.

I claim:

1. A method of creating a discontinuity in a stack of interfolded sheets, wherein the stack is formed at the discharge of a pair of folding rolls which are supplied with a stream of overlapping sheets by a pair of rolls located upstream of the folding rolls, comprising the steps of:

creating a differential in the speed of advancement between an upstream one of the sheets in the stream of overlapping sheets relative to a downstream one of the sheets in the stream of overlapping sheets, wherein the differential in the speed of advancement between the upstream and downstream sheets is operable to advance a trailing portion of the downstream sheet relative to a leading portion of the upstream sheet to eliminate the overlapping relationship therebetween; and supplying the stream of sheets to the folding rolls, wherein the folding rolls are operable to interfolded the sheets and to discharge the interfolded sheets to form the stack of interfolded sheets;

wherein elimination of the overlapping relationship between the trailing portion of the downstream sheet and the leading portion of the upstream sheet is operable to form a discontinuity in the stack of interfolded sheets discharged by the folding rolls.

2. The method of claim 1, wherein the step of creating the differential in the speed of advancement between the upstream and downstream sheets is carried out by slowing the speed of advancement of the upstream sheet.

3. The method of claim 2, wherein the step of slowing the speed of advancement of the upstream sheet is carried out by slowing the speed of rotation of the pair of rolls located upstream of the folding rolls subsequent to discharge of the trailing portion of the downstream sheet.

4. The method of claim 3, wherein the stream of sheets is supplied directly to the folding rolls from the pair of rolls located upstream of the folding rolls, and wherein a leading portion of the downstream sheet is located between the folding rolls upon discharge of the trailing portion of the downstream sheet from the pair of rolls located upstream of the folding rolls, wherein the step of slowing the speed of operation of the pair of rolls is carried out while maintaining the speed of operation of the folding rolls such that the folding rolls function to advance the downstream sheet at a faster rate of advancement relative to the speed of advancement of the upstream sheet by the pair of rolls.

5. The method of claim 4, wherein the folding rolls and the pair of rolls upstream therefrom are normally operated to provide substantially the same surface rate of speed of advancement of the sheets, such that slowing the speed of operation of the pair of rolls results in a reduction in the speed of advancement of the sheets by the pair of rolls relative to the normal speed of advancement by the pair of rolls, and further comprising the step of resuming the normal speed of advancement of the sheets by the pair of rolls subsequent to discharge of the trailing portion of the downstream sheet from the pair of rolls toward the folding rolls.

6. A method of forming a discontinuity in a stack of interfolded sheets that are formed in an interfolding system in which a stack of interfolded sheets is formed at the discharge of a pair of folding rolls which are supplied with a stream of overlapping sheets, comprising the step of separating a downstream one of the sheets from an upstream one of the sheets by advancing the downstream sheet relative to the upstream sheet at a location upstream of the folding rolls while maintaining the sheets adjacent the upstream sheet in an overlapping relationship and maintaining the sheets adjacent the downstream sheet in an overlapping relationship, wherein the separation between the upstream sheet and the downstream sheet eliminates the overlapping relationship between the downstream sheet and the upstream sheet and wherein, when the sheets are discharged from the folding rolls, the separation of the downstream sheet from the upstream sheet functions to separate a downstream stack of sheets which includes the downstream sheet from an adjacent upstream stack of sheets which includes the upstream sheet.

7. The method of claim 6, wherein the sheets are supplied to the folding rolls by a pair of feed rolls located upstream of the folding rolls, and wherein the step of advancing the downstream sheet relative to the upstream sheet is carried out by operating the folding rolls at a speed greater than that of the feed rolls so as to advance a trailing portion of the downstream sheet relative to a leading portion of the upstream sheet.

8. The method of claim 7, wherein the feed rolls and the folding rolls are normally operated at substantially similar speeds of rotation to form the stack of interfolded sheets at the discharge of the pair of folding rolls, and wherein the step of advancing the downstream sheet relative to the upstream sheet is carried out by slowing the speed of operation of the feed rolls relative to the folding rolls so that the relative decrease in the speed of operation of the feed rolls functions to slow advancement of the upstream sheet relative to the downstream sheet.

9. The method of claim 8, wherein the step of slowing the speed of operation of the feed rolls is carried out immediately upon discharge of the trailing end of the downstream sheet from between the feed rolls.

10. A method of forming a discontinuity in a stack of interfolded sheets that are formed in an interfolding system in which the stack of interfolded sheets is formed at the discharge of a pair of folding rolls which are supplied with a stream of overlapping sheets, comprising the step of separating a downstream one of the sheets from an upstream one of the sheets by advancing the downstream sheet relative to the upstream sheet at a location upstream of the folding rolls, to eliminate the overlapping relationship between the downstream sheet and the upstream sheet, wherein the sheets are supplied to the folding rolls by a pair of feed rolls located upstream of the folding rolls, and wherein the step of advancing the downstream sheet relative to the upstream sheet is carried out by operating the folding rolls at a speed greater than that of the feed rolls so as to advance a trailing portion of the downstream sheet relative to a leading portion of the upstream sheet.

11. The method of claim 10, wherein the feed rolls and the folding rolls are normally operated at substantially similar speeds of rotation to form the stack of interfolded sheets at the discharge of the pair of folding rolls, and wherein the step of advancing the downstream sheet relative to the upstream sheet is carried out by slowing the speed of operation of the feed rolls relative to the folding rolls so that the relative decrease in the speed of operation of the feed rolls functions to slow advancement of the upstream sheet relative to the downstream sheet.

12. The method of claim 11, wherein the step of slowing the speed of operation of the feed rolls is carried out immediately upon discharge of the trailing end of the downstream sheet from between the feed rolls.

13. A sheet interfolding system for forming a stack of interfolded sheets from a series of overlapping sheets, comprising:

a pair of rotatable folding rolls;

a pair of feed rolls located upstream of the folding rolls, wherein the feed rolls are operable to supply overlapping sheets to the folding rolls, and wherein operation of the folding rolls functions to form a stack of interfolded sheets at a discharge area defined by the folding rolls;

wherein the feed rolls and the folding rolls are normally operated so as to coordinate delivery of the overlapping sheets from the feed rolls to the folding rolls to interfolded the sheets in an overlapping relationship, and wherein the feed rolls and the folding rolls are adapted to selectively operate a differential rate of speed to advance a downstream sheet in the stream of overlapping sheets relative to an upstream sheet in the stream of overlapping sheets, to separate the downstream sheet from the upstream sheet;

wherein the downstream sheet and the upstream sheet are successively supplied by the feed rolls to the folding rolls and wherein the separation between the downstream sheet and the upstream sheet functions to create a discontinuity in the stack of interfolded sheets formed at the discharge of the folding rolls.

14. The sheet interfolding system of claim 13, wherein the differential in the speed of operation between the folding rolls and the feed rolls is caused by slowing the speed of rotation of the feed rolls relative to the speed of rotation of the folding rolls, wherein the folding rolls function to advance the trailing portion of the downstream sheet relative to the leading portion of the upstream sheet to separate the downstream sheet from the upstream sheet.

15. The sheet interfolding system of claim 14, wherein the speed of rotation of the feed rolls is slowed relative to the speed of rotation of the folding rolls upon discharge of the trailing end of the upstream sheet from between the feed rolls.

16. The sheet interfolding system of claim 15, wherein the downstream sheet is located between the folding rolls upon discharge of the trailing edge of the downstream sheet from between the feed rolls, wherein rotation of the folding rolls functions to advance the downstream sheet relative to the upstream sheet, which is located between the feed rolls.

* * * * *

UNITED STATES PATENT AND TRADEMARK OFFICE

CERTIFICATE OF CORRECTION

PATENT NO. : 6,689,038 B2
DATED : February 10, 2004
INVENTOR(S) : Barton J. White It is certified that error appears in the above-identified patent and that said Letters Patent is hereby corrected as shown below:

Column 7,
Line 30, delete “interfolded” and substitute therefor -- interfold --.

Column 9,
Lines 32-33, delete “interfolded” and substitute therefor -- interfold --.

Signed and Sealed this

Thirteenth Day of April, 2004

JON W. DUDAS
*Acting Director of the United States Patent and Trademark Office*